US010629363B2

(12) United States Patent
Ashizawa et al.

(10) Patent No.: US 10,629,363 B2
(45) Date of Patent: Apr. 21, 2020

(54) COIL DEVICE

(71) Applicant: TDK CORPORATION, Tokyo (JP)

(72) Inventors: Syun Ashizawa, Tokyo (JP); Toshio Tomonari, Tokyo (JP); Hirohumi Asou, Tokyo (JP); Emi Ito, Tsuruoka (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 15/446,601

(22) Filed: Mar. 1, 2017

(65) Prior Publication Data

US 2017/0263373 A1 Sep. 14, 2017

(30) Foreign Application Priority Data

Mar. 11, 2016 (JP) ..... 2016-048640

(51) Int. Cl.
*H01F 17/04* (2006.01)
*H01F 27/28* (2006.01)
*H01F 27/29* (2006.01)

(52) U.S. Cl.
CPC ..... *H01F 27/2823* (2013.01); *H01F 17/045* (2013.01); *H01F 27/29* (2013.01); *H01F 27/292* (2013.01)

(58) Field of Classification Search
USPC ..... 336/221
See application file for complete search history.

(56) References Cited

U.S. PATENT DOCUMENTS 7,113,067 B2 * 9/2006 Hirai ..... H01F 17/045 336/192
2016/0365191 A1 * 12/2016 Horie ..... H01F 27/24

FOREIGN PATENT DOCUMENTS

JP 2010-258314 A 11/2010
JP 2011-192729 A 9/2011

* cited by examiner

*Primary Examiner* — Ronald Hinson
(74) *Attorney, Agent, or Firm* — Oliff PLC

(57) ABSTRACT

A coil device includes a winding core with a coil portion wound by a wire, first and second flanges with open magnetic circuit respectively formed on both sides of the winding core in an axial direction, and a first facing surface of the first flange and a second facing surface of the second flange facing each other in the axial direction on an outer circumference side of the coil portion. S1/S2 is 0.2 to 1.0, where S1 is a maximum lateral cross sectional area of the winding core as seen from the axial direction, and S2 is a projected overlapping area overlapped by the first facing surface and the second facing surface as seen from the axial direction.

5 Claims, 5 Drawing Sheets

COIL DEVICE

BACKGROUND OF THE INVENTION

1. Field of the Invention

The present invention relates to a coil device having an open magnetic circuit-type core member consisting of a winding core and a pair of flanges.

2. Description of the Related Art

For improvement in magnetic properties, such as inductance, it is common to increase a cross sectional area of a magnetic body as shown in paragraph [0008] of Patent Document 1, for example. In a coil device having an open magnetic circuit-type core member consisting of a winding core and a pair of flanges, it is also conceivable that magnetic properties, such as inductance, are simply improved by increasing a lateral cross sectional area of the winding core.

Patent Document 1: JP 2011-192729A

SUMMARY OF THE INVENTION

The present invention has been achieved under such circumstances. It is an object of the invention to provide a coil device capable of improving magnetic properties, such as inductance, based on a different principle from conventional ones.

As a result of industrious studies for open magnetic circuit-type coil devices, the present inventors have found out that magnetic properties, such as inductance, can be improved by having a specific ratio between a projected overlapping area of facing surfaces of a pair of flanges and a cross sectional area of a winding core. Then, the present inventors have achieved the present invention.

That is, the coil device according to the present invention is a coil device including:

a winding core with a coil portion wound by a wire;

first and second flanges with open magnetic circuit respectively formed on both sides of the winding core in an axial direction; and a first facing surface of the first flange and a second facing surface of the second flange facing each other in the axial direction on an outer circumference side of the coil portion, wherein S1/S2 is 0.2 to 1.0, where S1 is a maximum lateral cross sectional area of the winding core as seen from the axial direction, and S2 is a projected overlapping area overlapped by the first facing surface and the second facing surface as seen from the axial direction.

S1/S2 is preferably 0.3 to 1.0, and is more preferably 0.3 to 0.7. When S1/S2 is in such range, magnetic properties, such as inductance, are improved. The reason why magnetic properties, such as inductance, are improved when S1/S2 is in the above-mentioned range is not necessarily clear, but is conceived as below, for example.

That is, it is conceivable that when the winding core has a small cross sectional area unlike conventional cases, the projected overlapping area overlapped by the first facing surface and the second facing surface becomes relatively large, a spatial magnetic circuit is formed between the facing surfaces facing each other, and its influence becomes large. The above-mentioned improvement in magnetic properties, such as inductance, is particularly remarkably demonstrated when the coil device is small.

Preferably, a total length of the coil device L0=L1+T1+T2 is 10 mm or less, where L1 is a length in the axial direction of the winding core, T1 is a thickness in the axial direction of the first flange, and T2 is a thickness in the axial direction of the second flange. This remarkably demonstrates the effect of the present invention.

Preferably, a smaller one of H1 and H2 is 5 mm or less, and a smaller one of W1 and W2 is 5 mm or less, where H1 is a maximum height of the first flange, H2 is a maximum height of the second flange, W1 is a maximum width of the first flange, and W2 is a maximum width of the second flange. This remarkably demonstrates the effect of the present invention.

DESCRIPTION OF THE PREFERRED EMBODIMENTS

Hereinafter, the present invention will be described based on an embodiment shown in the figures.

Figure 1:
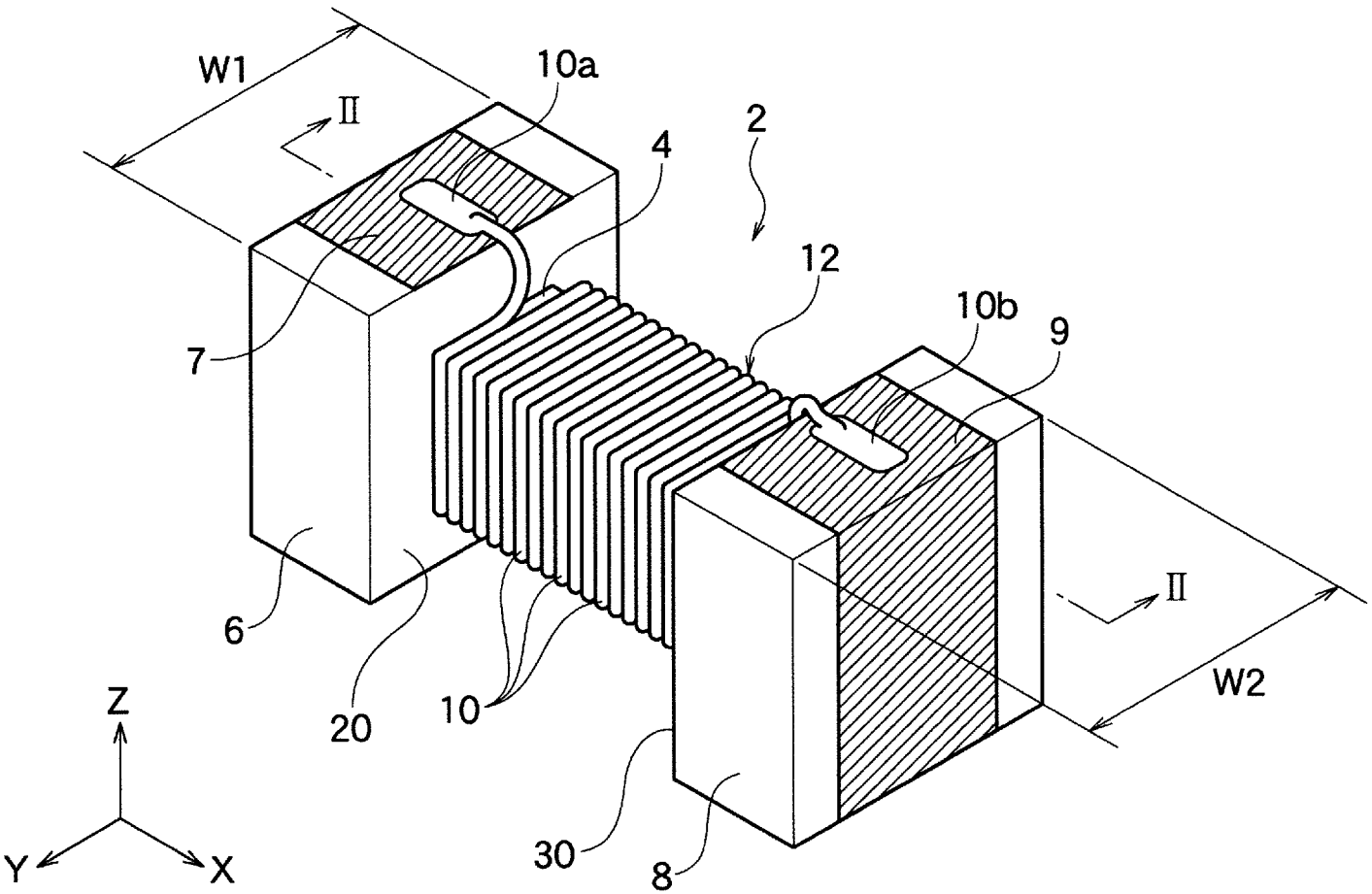
FIG. 1 is a schematically perspective view of a coil device according to an embodiment of the present invention.

A coil device 2 according to an embodiment of the present invention shown in FIG. 1 is used a signal system coil, such as common mode filter, a power supply system coil, a signal system bead, or the like. The coil device 2 includes a winding core 4 having an axial core in the X-axis direction, and a first flange 6 and a second flange 8 that are open magnetic circuit type and are respectively formed on both sides in the X-axis direction of the winding core 4. Incidentally, the X-axis, the Y-axis, and the Z-axis are vertical to each other in the figures.

An individual or multiple wires 10 are wound around an outer circumference of the winding core 4 by single layer or multiple layers. In the illustrated embodiment, a individual wire 10 is spirally wound around the outer circumference of the winding core 4 by single layer so as to form a coil portion 12, but the present invention is not limited to this embodiment. A first end 10*a* of the wire 10 is electrically connected to a first terminal electrode 7 formed on an outer surface of the first flange 6 and is fixed. A second end 10*b* positioned opposite to the first end 10*a* of the wire 10 is electrically connected to a second terminal electrode 9 formed on an outer surface of the second flange 8 and is fixed.

The wire 10 may be any wire, such as resin coated wire. The wire 10 has any diameter, but preferably has a diameter of 0.01 to 0.1 mm.

The winding core 4 and the pair of flanges 6 and 8 are integrally formed as a drum core, and may be constituted by a magnetic body such as ferrite and metal magnetic body or by a nonmagnetic body such as alumina. The drum core is constituted by a magnetic body material whose specific permeability μ is preferably 50 or more, more preferably 100 or more, and particularly preferably 200 or more.

Figure 2:
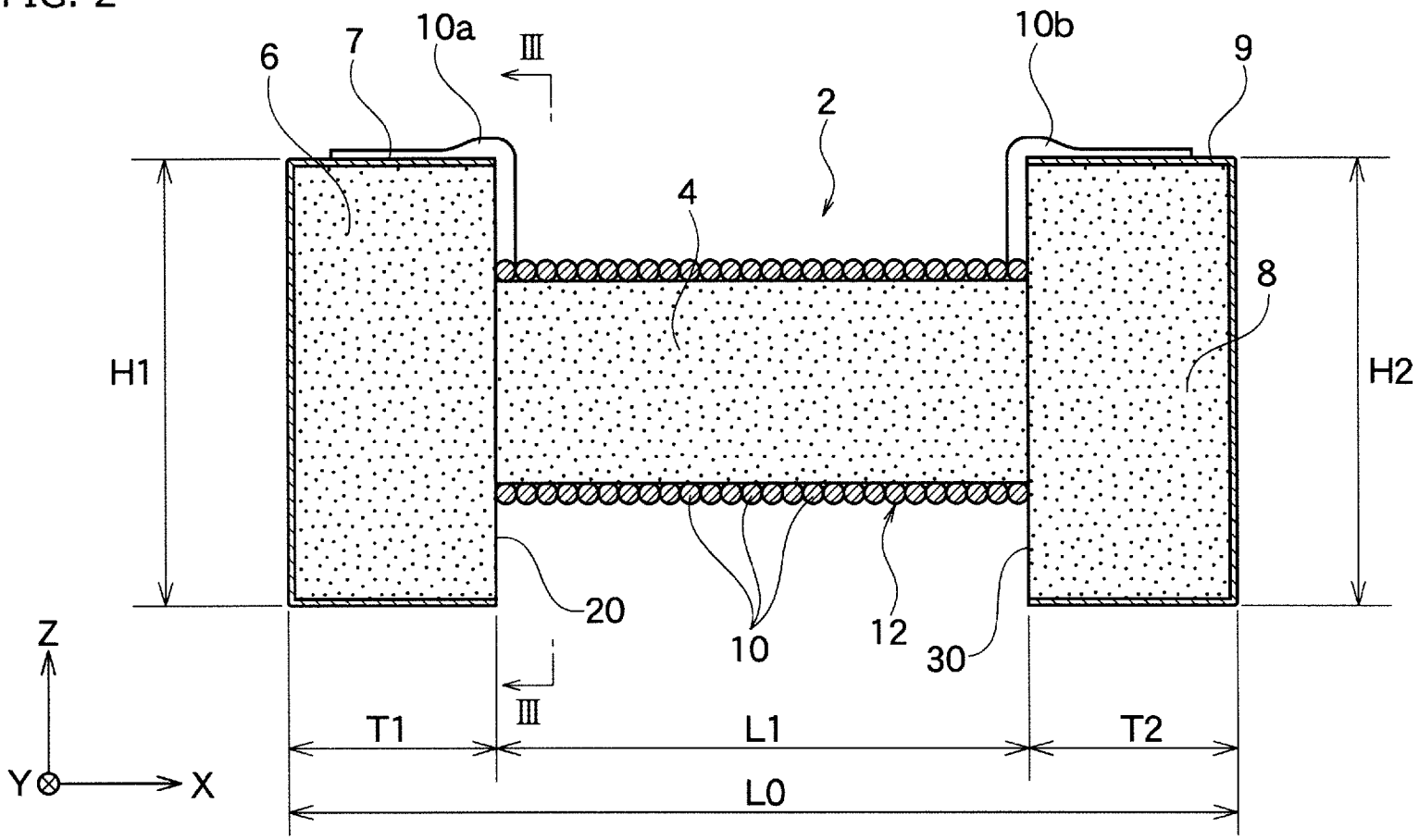
FIG. 2 is a longitudinal cross sectional view of the coil device along the II-II line shown in FIG. 1.

In the present embodiment, the coil device 2 has any size, but the coil device 2 having a small size is effective. For example, as shown in FIG. 2, a total length of the coil device 2 L0=L1+T1+T2 is preferably 10 mm or less, where L1 is a length in the X-axis direction of the winding core 4, T1 is a thickness in the X-axis direction of the first flange 6, and T2 is a thickness in the X-axis direction of the second flange 8. The total length L0 is more preferably 0.4 to 10.0 mm. This remarkably demonstrates the following effect.

As shown in FIG. 2, a smaller one of H1 and H2 is 5 mm or less, and a smaller one of W1 and W2 is 5 mm or less, where H1 is a maximum height (Z-axis direction) of the first flange 6, H2 is a maximum height of the second flange 8, W1 is a maximum width (Y-axis direction) of the first flange 6, and W2 is a maximum width of the second flange 8.

Figure 3:
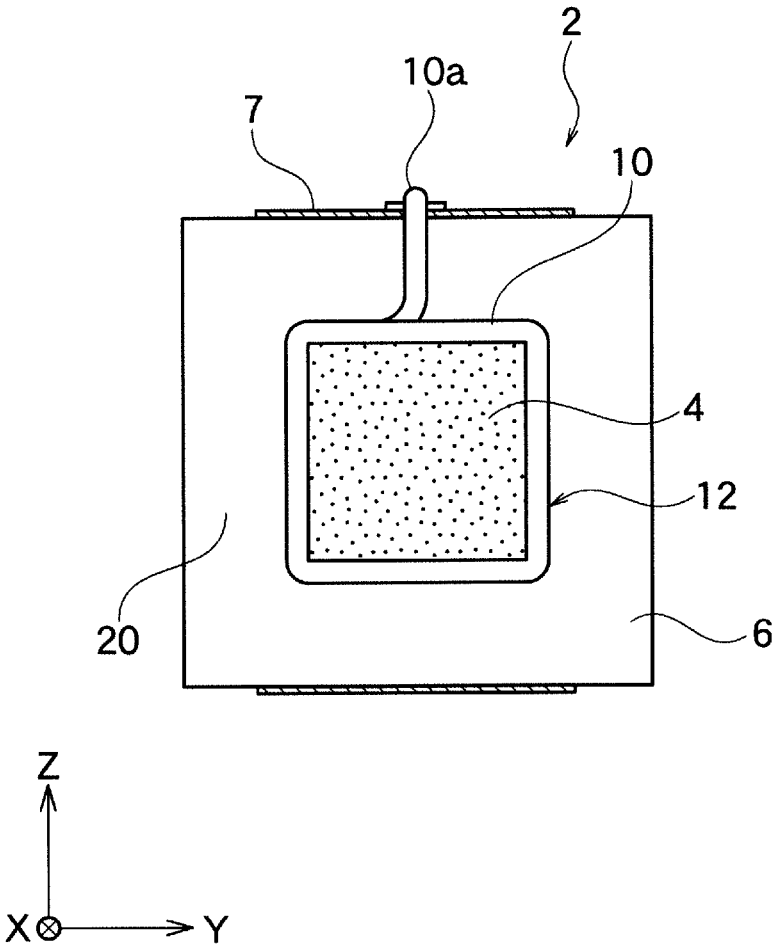
FIG. 3 is a lateral cross sectional view of the coil device along the line shown in FIG. 2.

In the present embodiment, as shown in FIG. 3, the first flange 6 has a large length in the Y-axis and Z-axis directions in comparison with a lateral cross sectional view of the winding core 4, and a first facing surface 20 with a comparatively large area is formed on an inner surface (winding core side) of the first flange 6 on an outer circumference side of the coil portion 12. FIG. 3 illustrates only the first facing surface 20, but a second facing surface 30 facing the first facing surface 20 in the X-axis direction is similarly formed on an inner surface of the second flange 8 shown in FIG. 1 and FIG. 2.

Figure 5:
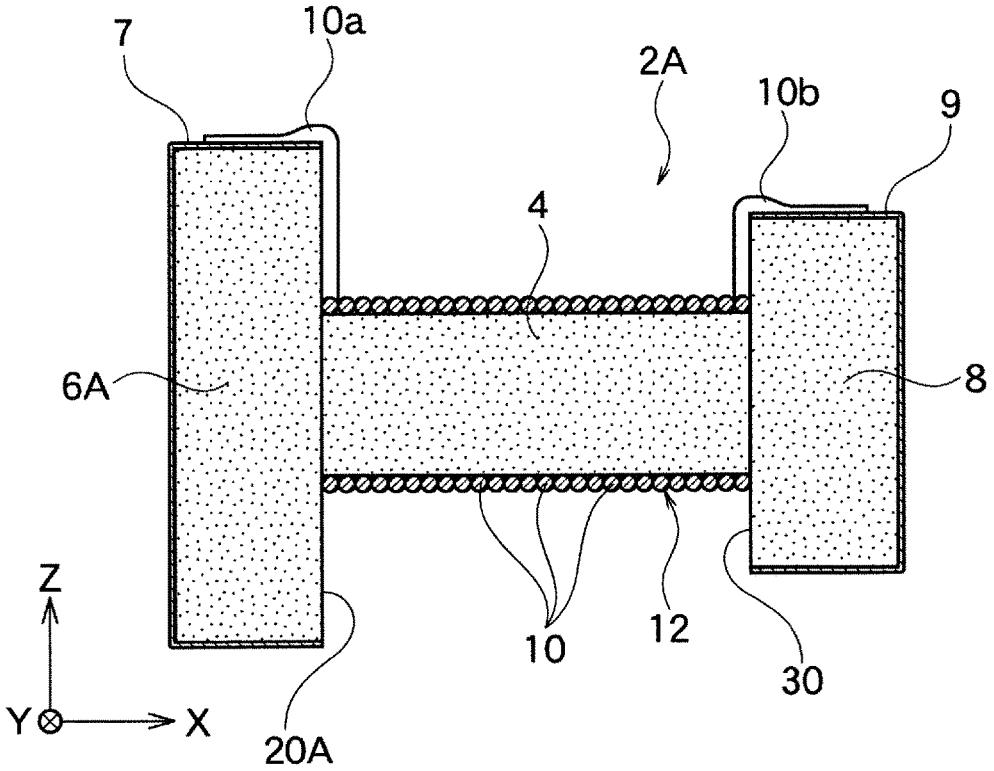
FIG. 5 is a schematically longitudinal cross sectional view of a coil device according to another embodiment of the present invention.

The first facing surface 20 and the second facing surface 30 respectively has the same area in the present embodiment, but as shown in a coil device 2A shown in FIG. 5, a first flange 6A may have a large size in the Y-axis direction and/or the Z-axis direction, and a first facing surface 20A may have a larger area than an area of the second facing surface 30. Instead, the second surface may have a larger area than an area of the first facing surface.

Figure 6:
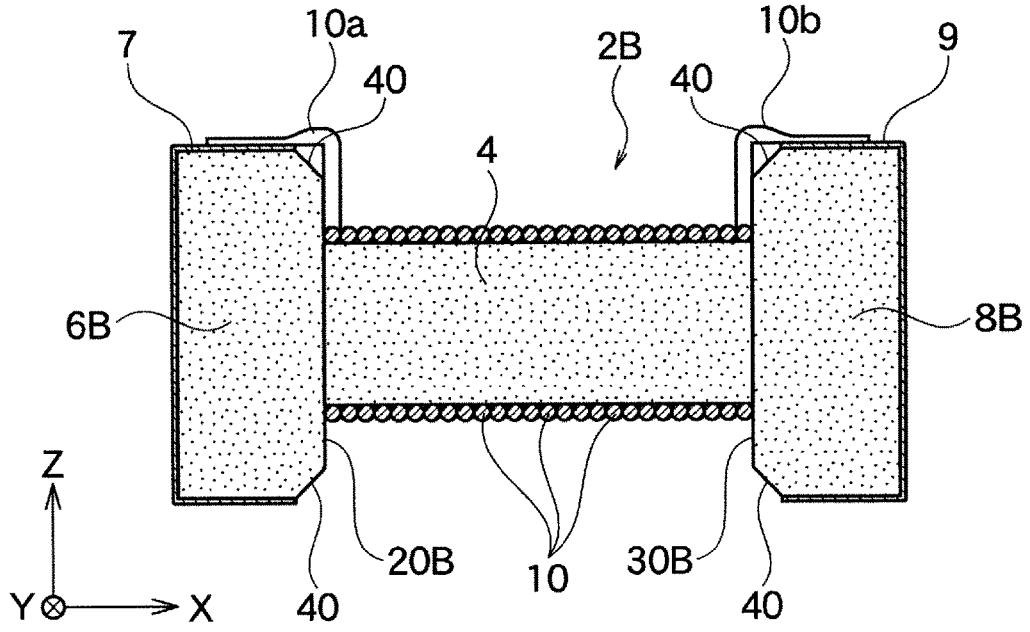
FIG. 6 is a schematically longitudinal cross sectional view of a coil device according to further another embodiment of the present invention.

For example, as shown in a coil device 2B shown in FIG. 6, a chamfering part 40 inclined toward a plane surface parallel to the Z-axis and the Y-axis, another inclined surface, a curved surface such as R part, or the like, may be formed on at least one of a first facing surface 20B of a first flange 6B and a second facing surface 30B of a second flange 8B.

Furthermore, the winding core 4 has a lateral cross section of an approximately square shape in the present embodiment, but has any lateral cross sectional shape, such as another polygon, a circle, an ellipse, and another shape. A lateral cross section of the flanges 6 and 8 is not limited to a square either, but may be another polygon, a circle, an ellipse, and another shape.

The thickness in the X-axis direction of the first flange 6 and the thickness in the X-axis direction of the second flange 8 shown in FIG. 2 may be the same or different, and are a thickness capable of maintaining strength. The winding core 4 has a lateral cross sectional area that does not change along the X-axis direction in the present embodiment, but the lateral cross sectional area may change to be largest in the middle part in the X-axis direction, for example.

In any case, in the present embodiment, S1/S2 is 0.2 to 1.0, S1/S2 is preferably 0.3 to 1.0, and S1/S2 is more preferably 0.3 to 0.7, where S1 is a maximum lateral cross sectional area of the winding core 4 as seen from the X-axis direction, and S2 is a projected overlapping area overlapped by the first facing surface 20 and the second facing surface 30 facing each other in the X-axis direction on the outer circumference side of the coil portion 12 as seen from the X-axis direction.

Figure 4:
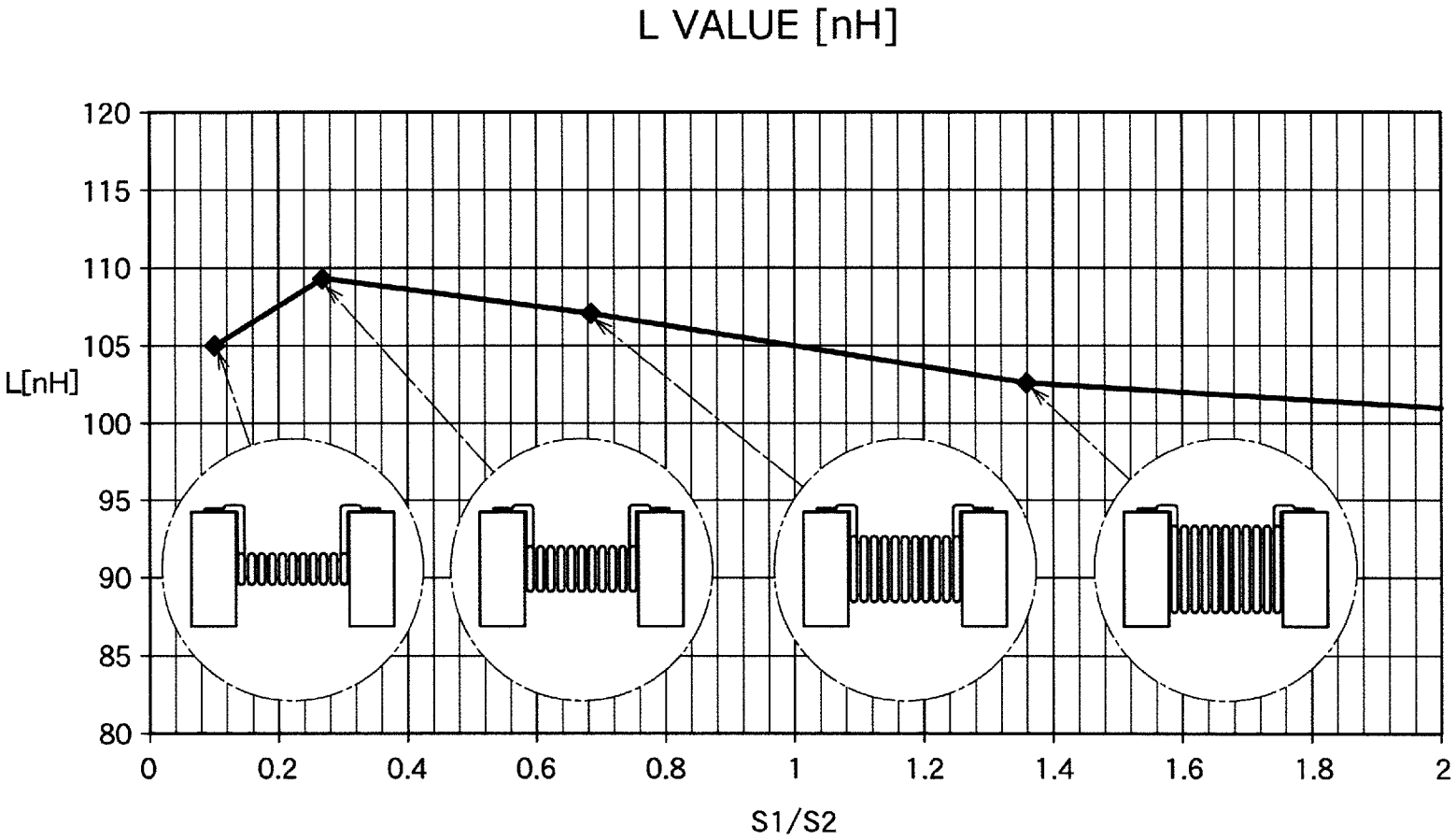
FIG. 4 is a graph showing a relation between an area S1 of a winding core of a coil device and a projected area S2 of facing surfaces between flanges.

As shown in FIG. 4, magnetic properties, such as inductance L, are improved when S1/S2 is in the above-mentioned range. Incidentally, when S1/S2 is too small, a lateral cross sectional area of the winding core tends to be too small, and a mechanical strength tends to decrease too much. Incidentally, the reason why magnetic properties, such as inductance, are improved when S1/S2 is in the above-mentioned range is not necessarily clear, but is conceived as below, for example.

That is, it is conceivable that when the winding core 4 has a small cross sectional area unlike conventional cases, a projected overlapping area overlapped by the first facing surface 20 and the second facing surface 30 becomes relatively large, a spatial magnetic circuit is formed between the facing surfaces 20 and 30 facing each other, and its influence becomes large. The above-mentioned improvement in magnetic properties, such as inductance, is particularly remarkably demonstrated when the coil devices 2, 2A, and 2B are small.

Incidentally, FIG. 4 shows results performed in the following conditions. That is, the following drum core is prepared: widths in the Y-axis direction of the flanges 6 and 8 shown in FIG. 1 are W1=W2=0.33 mm; and L1=0.44 mm, T1=T2=0.13 mm, and H1=H2=0.43 mm shown in FIG. 2.

The wire 10 is a polyurethane copper wire having a diameter of φ0.01 to φ0.1 mm and is wound around the winding core 4 by single layer. Except for changing a maximum lateral cross sectional area S1 of the winding core 4, samples of similar coil devices are made, and inductance L of each coil device sample is measured using an impedance analyzer. The results are shown in FIG. 4.

Incidentally, the present invention is not limited to the above-mentioned embodiment, but may be variously changed within the scope of the present invention.

NUMERICAL REFERENCES

2, 2A, 2B . . . coil device
4 . . . winding core
6, 6A, 6B . . . first flange
7 . . . first terminal electrode
8, 8B . . . second flange
9 . . . second terminal electrode
10 . . . wire
12 . . . coil portion
20, 20A, 20B . . . first facing surface
30, 30B . . . second facing surface
40 . . . chamfering part

The invention claimed is:

1. A coil device comprising:

a winding core;

a coil portion formed by a wire around the winding core;

first and second flanges with open magnetic circuit respectively formed on both sides of the winding core in an axial direction; and a first facing surface of the first flange and a second facing surface of the second flange facing each other in the axial direction on an outer circumference side of the coil portion, wherein S1/S2 is 0.3 to 1.0, where S1 is a maximum lateral cross sectional area of the winding core as seen from the axial direction, and S2 is a projected overlapping area overlapped by the first facing surface and the second facing surface facing each other in the axial direction on the outer circumference side of the coil portion as seen from the axial direction, the first and second flanges are not connected with a magnetic body other than the winding core, and a spatial magnetic circuit is formed between the first facing surface and the second facing surface facing each other so as to surround a periphery of the winding core.

2. The coil device according to claim 1, wherein a smaller one of H1 and H2 is 5 mm or less, and a smaller one of W1 and W2 is 5 mm or less, where H1 is a maximum height of the first flange, H2 is a maximum height of the second flange, W1 is a maximum width of the first flange, and W2 is a maximum width of the second flange.

3. The coil device according to claim 1, wherein a total length of the coil device L0=L1 +T1+T2 is 10 mm or less, where L1 is a length in the axial direction of the winding core, T1 is a thickness in the axial direction of the first flange, and T2 is a thickness in the axial direction of the second flange.wherein the cover comprises an inserting groove formed therein into which the second core is detachably disposed such that the cover surrounds a top surface and a bottom surface of the second core entirely when the second core is disposed in the cover.

4. The coil device according to claim 2, wherein a smaller one of H1 and H2 is 5 mm or less, and a smaller one of W1 and W2 is 5 mm or less, where H1 is a maximum height of the first flange, H2 is a maximum height of the second flange, W1 is a maximum width of the first flange, and W2 is a maximum width of the second flange.

5. A coil device comprising:

a winding core;

a coil portion formed by a wire around the winding core;

first and second flanges with open magnetic circuit respectively formed on both sides of the winding core in an axial direction; and a first facing surface of the first flange and a second facing surface of the second flange facing each other in the axial direction on an outer circumference side of the coil portion, wherein S1/S2 is 0.3 to 0.7, where S1 is a maximum lateral cross sectional area of the winding core as seen from the axial direction, and S2 is a projected overlapping area overlapped by the first facing surface and the second facing surface facing each other in the axial direction on the outer circumference side of the coil portion as seen from the axial direction, the first and second flanges are not connected with a magnetic body other than the winding core, and a spatial magnetic circuit is formed between the first facing surface and the second facing surface facing each other so as to surround a periphery of the winding core.

* * * * *